US010077769B2

(12) United States Patent
Giacaman

(10) Patent No.: US 10,077,769 B2
(45) Date of Patent: Sep. 18, 2018

(54) FUEL-PUMP CONTROLLER

(76) Inventor: Miguel S. Giacaman, San Francisco, CA (US)

( * ) Notice: Subject to any disclaimer, the term of this patent is extended or adjusted under 35 U.S.C. 154(b) by 341 days.

(21) Appl. No.: 10/491,325

(22) PCT Filed: Oct. 2, 2002

(86) PCT No.: PCT/US02/31639
§ 371 (c)(1),
(2), (4) Date: Jul. 27, 2004

(87) PCT Pub. No.: WO03/029134
PCT Pub. Date: Apr. 10, 2003

(65) Prior Publication Data
US 2004/0260425 A1 Dec. 23, 2004

(51) Int. Cl.
*G07F 11/00* (2006.01)
*F04B 49/06* (2006.01)

(52) U.S. Cl.
CPC ..... *F04B 49/065* (2013.01); *G07F 11/002* (2013.01)

(58) Field of Classification Search
CPC ..... G07F 13/025
See application file for complete search history.

(56) References Cited

U.S. PATENT DOCUMENTS 5,895,457 A * 4/1999 Kurowski ..... G06Q 20/20 700/232
6,176,421 B1 * 1/2001 Royal, Jr. ..... B67D 7/222 700/241
6,275,746 B1 * 8/2001 Leatherman ..... G06Q 30/0601 700/241
8,666,542 B2 * 3/2014 Durham ..... F02D 41/26 700/236
2002/0128988 A1 * 9/2002 Covington ..... B67D 7/14 705/413
2004/0204999 A1 * 10/2004 Negley, III ..... G06Q 20/202 705/16

* cited by examiner

*Primary Examiner* — Timothy R Waggoner
(74) *Attorney, Agent, or Firm* — Frank Huy Pham; Pham IP Group

(57) ABSTRACT

Disclosed herein is a dedicated pump controller apparatus for installation dedicated to and proximate a single fuel pump, comprising: at least one processor; data memory; and at least one fuel pump communications interface for communicating with said fuel pump. Further disclosed is a method for controlling fuel pumps using a dedicated pump controller comprising at least one processor and at least one data memory, comprising the steps of: installing a dedicated pump controller proximate to a single fuel pump; dedicating said dedicated pump controller to said single fuel pump; and communicating between said dedicated pump controller and said at least one fuel pump over at least one communications interface therebetween.

22 Claims, 2 Drawing Sheets

FUEL-PUMP CONTROLLER

FIELD OF THE INVENTION

This invention relates to the control of fuel pumps, and particularly to a dedicated pump controller that supplements or acts in lieu of the multi-pump pump controller used in present gas station configurations.

BACKGROUND OF THE INVENTION

At present fuel pumps at gas stations are controlled by a "pump controller" equipment that interfaces one or more Point of Sale terminals (POS's) with one or more fuel pumps, typically one POS for anywhere from 4 to 16 pumps. This architecture possesses several drawbacks. If the POS or pump controller fails, becomes busy, overloaded or experiences communication problems then the fuel pumps are unable to function (deliver fuel) since they depend upon communication with the pump controller to receive the appropriate commands, e.g. authorization, pump start, retrieving of the transaction data and real time volume and amount. Further, all communications with the pumps are funneled through a single pump controller using one or two serial communication links. On each link only one pump can be addressed at a time creating a communications bottleneck.

When the control system fails due to failure of the POS, controller, or wiring, all the pumps connected to a link stop fueling. A common practice in response to these events (loss of control due to controller system failure) is to set the fuel dispensers into a "stand alone" mode in which they function autonomously from a control system.

The main disadvantage of this practice is the lack of logging or recording of the fuel dispensed and associated data like: total amount, price per volume unit (price per litter), type of fuel (e.g. gasoline 91 octane) time and date, pump number assigned in a particular gas station, etc.

Another major limitation is the lack of issuance of a receipt for the customer, and the lack of a recording of the associated information for later tax and financial management.

Another limitation of prior art is that main pump controller are typically very expensive fixed cost items, any must be employed regardless of how many pumps are at the gas station. Thus, for example, a station operator with only two pumps pays four times as much for main pump controller, per pump, as a station operator with eight pumps.

SUMMARY OF THE INVENTION

Disclosed herein is a dedicated pump controller apparatus for installation dedicated to and proximate a single fuel pump, comprising: at least one processor; data memory; and at least one fuel pump communications interface for communicating with said fuel pump.

Further disclosed is a method for controlling fuel pumps using a dedicated pump controller comprising at least one processor and at least one data memory, comprising the steps of: installing a dedicated pump controller proximate to a single fuel pump; dedicating said dedicated pump controller to said single fuel pump; and communicating between said dedicated pump controller and said at least one fuel pump over at least one communications interface therebetween.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE INVENTION

Figure 1:
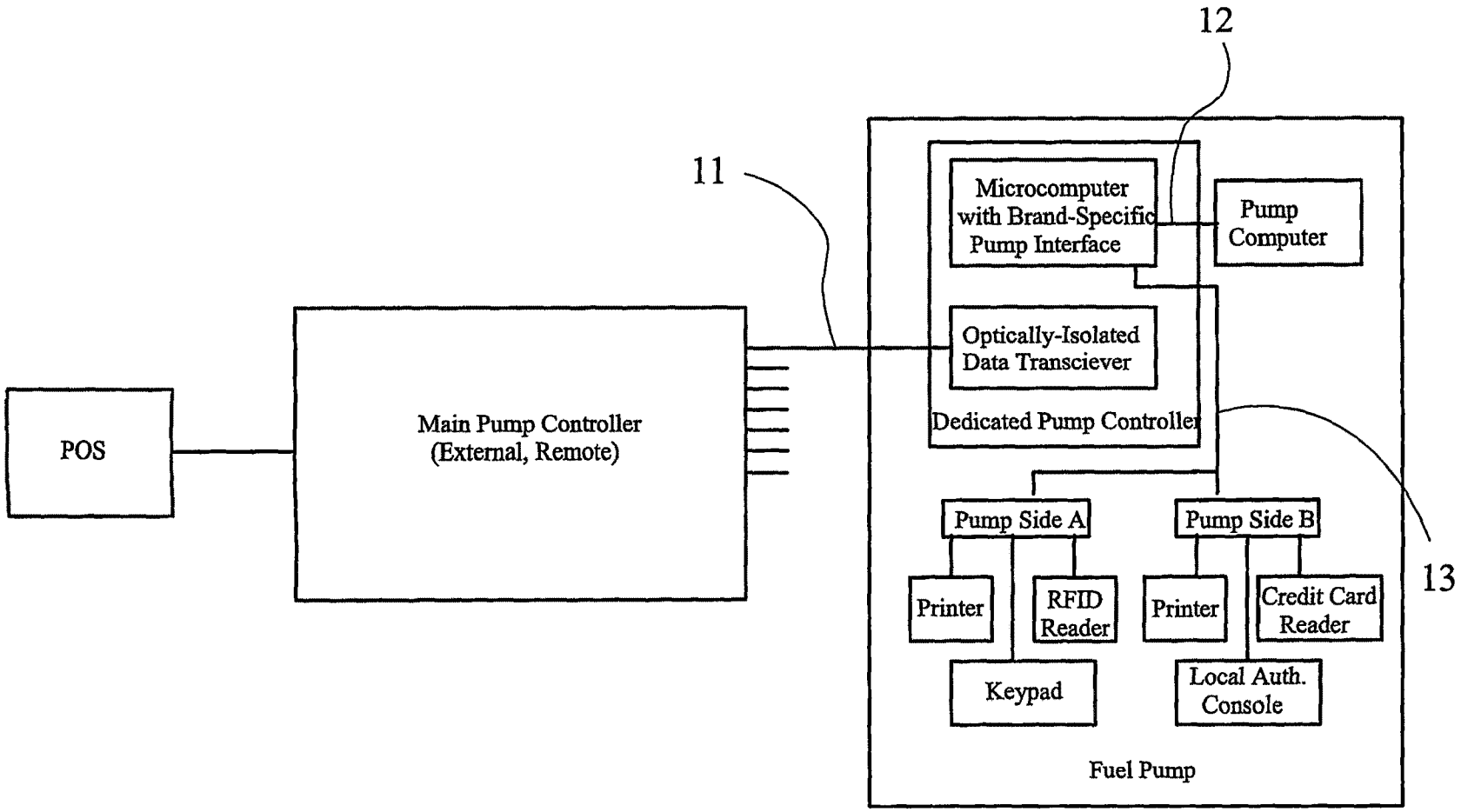
FIG. 1 is a schematic plan view illustrating a dedicated pump controller in accordance with the invention, as it fits in connection with a fuel pump and the other components of a typical gas station configuration.

A dedicated pump controller installed, one per fuel pump, proximate and in connection with each said fuel pump, is capable of functioning as a pump controller dedicated solely to the pump for which it is installed. This dedicated pump controller contains a microcomputer with a (brand-specific) pump communications interface and optionally a communications interface with a conventional (remote or external) main pump controller, which is non-dedicated and has control over one or more pumps at the gas station. If connected to such a main pump controller, the device may function as a slave to this main pump controller. Otherwise it may function autonomously to control the fuel pump on its own.

As used herein, a "fuel pump" is to be understood as a device useful for introducing liquid fuel into vehicles (e.g., car and truck) fuel tanks. This fuel pump must be able to measure at least the volume or amount dispensed. It may be a single or dual unit, e.g. able to execute one or two fuelings simultaneously with independent measurement. Most of the pumps in use are dual (two-sided) units with which vehicle drivers are very familiar.

As used herein, "dedicated" is understood to mean that each dedicated pump controller is exclusively dedicated to a single (single or dual-sided) fuel pump, As used herein, "proximate" and "in connection with" are understood to mean that the "proximate" pump controller is located either inside the fuel pump, or is directly upon or next to the pump, and to exclude the situation where the pump controller is, for example, located inside the building structure at the gas station and connected to the pump via some form of wiring.

This dedicated pump controller may also comprise one or more communication ports to interface and communicate with other devices installed "in" or "on" the pump such as receipt printers, credit card or other readers, keypads, displays, modems, local authorization consoles, etc.

The dedicated pump controller comprises a microcomputer and this 'by definition' includes at least one CPU (central processing unit), program memory and data memory. The latter may be used to store information concerning the fueling operation in either master (independent of the main pump controller) or slave (controlled by the main pump controller) modes.

This information may be kept in the memory as long as needed and retrieved by any device able to establish communication with this dedicated pump controller including but not limited to an external non-dedicated controller, or other alternative computerized device such as a notebook computer. This information may also be cumulative, representing one or more fueling process, thereby becoming a transaction log.

Such logging may include volume dispensed, price per volume unit (e.g. gallons or liters), amount (e.g. dollars and cents) dispensed, type of fuel (e.g. diesel or gasoline 91 octane's), time and date, pump identification (e.g. pump number assigned in one particular site) and any other information that the management may want to include.

That information or part of it may be retrieve later by a point of sale terminal, computer or any device able to establish communication with this dedicated pump controller.

A dedicated pump controller for a single fuel pump that goes inside the pump needs a very simple enclosure, if any, may use the fuel pump's power supply voltage saving having its own power converter, and it has a simplified communication interface just for one pump. As such, this is a low cost solution particularly suited to service stations with a small number of pumps. Considering that there is one dedicated pump controller for each pump its cost is proportional to the number of fuel pumps to be controlled.

A preferred embodiment of the dedicated pump controller comprise the following functionality: 1) Automatically printing receipts once the fueling operation is completed at fueling point, controlled by the dedicated pump controller rather than the main pump controller. 2) Maintaining a transaction log of a plurality of transactions per fueling point. 3) Comprising real time clock. 4) Storing setup parameters and transaction data in memory. 5) In those installations where a main pump controller is required, the dedicated pump controller must operate without causing conflict. 6) It comprises the capability to setup system parameters, receive information, upgrade application software, and retrieve sales information via an RS232 port connected, for example, to a notebook computer or similar alternative computerized device. 7) It has duplicate receipt means (e.g., a depressible button) for issuing a duplicate receipt of the last transaction for that particular fueling point. 8. It has shift summary means (such as a "SHIFT" button) that when activated will issue a shift summary report.

If the main pump controller or POS is out of order, or voluntarily or involuntarily disconnected from the dedicated pump controller, the dedicated pump controller will control and record all sales occurring at the pump to which it is dedicated. When the main pump controller or POS is back in order or reconnected, all data collected in the dedicated pump controller may be uploaded to the main pump controller.

Figure 2:
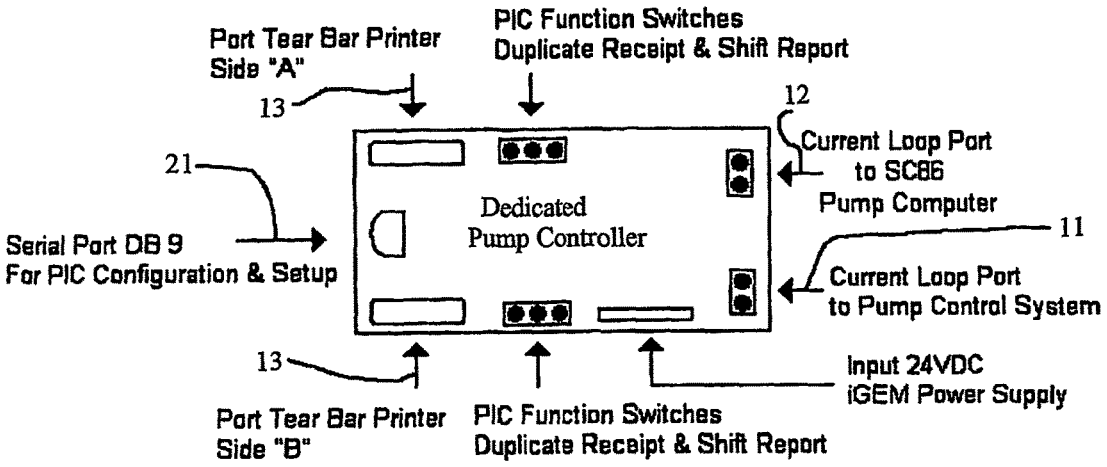
FIG. 2 is a schematic plan view illustrating the dedicated pump controller of FIG. 1 in a particular embodiment where it is used to drive pump printers.
Figure 3:
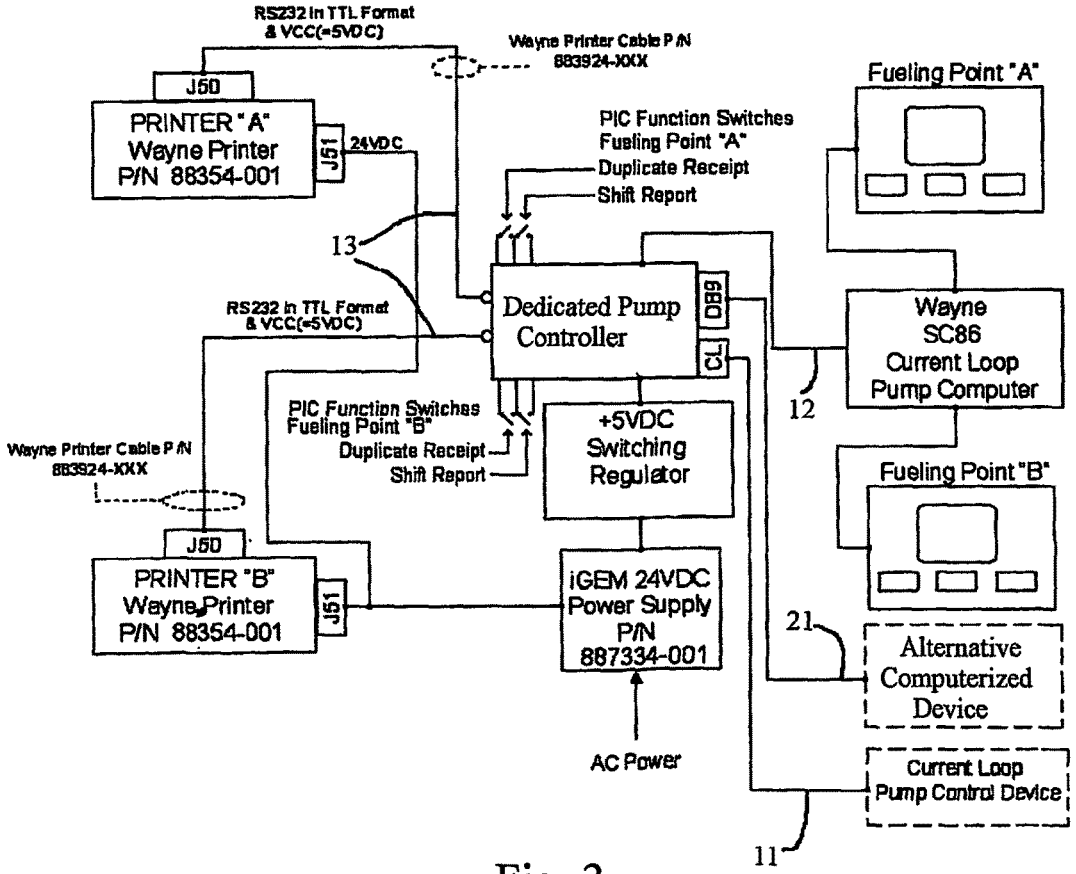
FIG. 3 is a schematic plan view illustrating the dedicated pump controller of FIG. 2, as it fits in connection with a fuel pump and the other components of a typical gas station configuration.

Reference numbers 11, 12, 13 and 21 highlight the correspondences among the connections illustrated in FIGS. 1, 2, and/or 3.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A dedicated pump controller apparatus for installation dedicated to and proximate a single fuel pump for controlling said single fuel pump comprising:

at least one processor;

data memory for storing transaction information regarding fueling operations of said fuel pump in said data memory;

at least one fuel pump communications interface directly connected to said fuel pump for communicating with said fuel pump;

at least one data communication interface for transferring data with said dedicated pump controller to a main pump controller and/or an external computerized device;

a program code to be executable by said at least one processor for controlling dispensing operations of said fuel pump via said at least one fuel pump communication interface to a pump computer associated therewith said fuel pump independently of a main pump controller wherein said data communication interface is inactive; and a program code to be executable by said at least one processor for enabling each said dedicated pump controller to control dispensing operations of said fuel pump independently of said main pump controller wherein said data communication interface is inactive;

a program code to be executable by said at least one processor for enabling said main pump controller to control dispensing operations of said fuel pump independently of said dedicated pump controller wherein said data communication interface is active.

2. The apparatus of claim 1 further comprising:

at least one main pump controller data communication interface for communicating with said main pump controller.

3. The apparatus of claim 2, further comprising:

data receipt for transferring data associated with said pump to said main pump controller via said dedicated pump controller.

4. The apparatus of claim 2 wherein said main pump controller is inactive and wherein said dedicated pump controller is enabled to control said fuel pump and accumulate data from said fuel pump when said main pump controller communication interface is inactive; and post-reactivation communication enabling data stored in said data memory to be communicated to said main pump controller once said main pump controller communications interface has been reactivated.

5. The apparatus of claim 1 further comprising:

main pump controller means for controlling said fuel pump via said dedicated pump controller.

6. The apparatus of claim 1, further comprising:

data recorder for recording at least one data item received over said at least one fuel pump communication interface.

7. The apparatus of claim 1 further comprising:

alternative communication for communicating with an alternative computerized device in lieu of communicating with said main pump controller.

8. The apparatus of claim 7 further comprising:

uploading alternative program code to be executable by said computer processor in said dedicated pump controller using said alternative computerized device via said alternative communication means.

9. The apparatus of claim 7, further comprising:

alternative upload for uploading data from said dedicated pump controller to said alternative computerized device via said alternative communications means.

10. The apparatus of claim 1 further comprising:

at least one peripheral device communication interface for communicating with at least one peripheral device installed in said fuel pump.

11. The apparatus of claim 10 wherein said at least one peripheral device comprising a receipt printer.

12. The apparatus of claim 10, further comprising:

peripheral device functional selection for selecting said at least one peripheral device.

13. The apparatus of claim 12 wherein said peripheral device comprising a printer; and said peripheral device functional selection causing said printer to print a first receipt.

14. The apparatus of claim 12 wherein said peripheral device comprising a printer; and said peripheral device functional selection for causing said printer to print a duplicate receipt.

15. The apparatus of claim 12 wherein said peripheral device comprising a printer; and said peripheral device functional selection for causing said printer to print a shift summary.

16. The apparatus of claim 12 wherein said peripheral device comprising a printer; and said peripheral device functional selection for causing said printer to print a transaction log.

17. The apparatus of claim 10 wherein said at least one peripheral device comprising a printer for printing data stored in said data memory.

18. The apparatus of claim 10:

said at least one peripheral device comprising a card reader.

19. The apparatus of claim 10:

said at least one peripheral device comprising an RFID reader.

20. The apparatus of claim 10:

said at least one peripheral device comprising a keypad.

21. The apparatus of claim 10:

said at least one peripheral device comprising a local authorization console.

22. The apparatus of claim 10:

said at least one peripheral device comprising a device for gathering information pertaining to fueling transactions.

* * * * *